US011649646B2

(12) United States Patent
Dagger

(10) Patent No.: US 11,649,646 B2
(45) Date of Patent: May 16, 2023

(54) PERFORMANCE FLOOR ASSEMBLY AND SYSTEM

(71) Applicant: BRITISH HARLEQUIN PLC, Kent (GB)

(72) Inventor: Guy Dagger, Kent (GB)

(73) Assignee: BRITISH HARLEQUIN PLC, Kent (GB)

( * ) Notice: Subject to any disclaimer, the term of this patent is extended or adjusted under 35 U.S.C. 154(b) by 0 days.

(21) Appl. No.: 17/802,458

(22) PCT Filed: Feb. 10, 2021

(86) PCT No.: PCT/GB2021/050297
§ 371 (c)(1),
(2) Date: Aug. 25, 2022

(87) PCT Pub. No.: WO2021/170970
PCT Pub. Date: Sep. 2, 2021

(65) Prior Publication Data

US 2023/0117310 A1 Apr. 20, 2023

(30) Foreign Application Priority Data

Feb. 25, 2020 (GB) ..... 2002662

(51) Int. Cl.
*E04F 15/22* (2006.01)

(52) U.S. Cl.
CPC ..... *E04F 15/225* (2013.01)

(58) Field of Classification Search
CPC ..... E04F 15/225; E04F 15/22
See application file for complete search history.

(56) References Cited

U.S. PATENT DOCUMENTS 6,363,671 B1 * 4/2002 O'Mara ..... E04F 15/225 52/480
2002/0189184 A1 * 12/2002 Shelton ..... E04F 15/225 52/480

FOREIGN PATENT DOCUMENTS

DE 19508464 A1 * 9/1996 ..... E04F 15/22
DE 19532606 A1 * 3/1997 ..... E04F 15/22
(Continued)

OTHER PUBLICATIONS

EPO/WO. PCT/GB2021/050297, PCT Written Opinion of the International Searching Authority dated May 21, 2021, (9 pgs).

*Primary Examiner* — Adriana Figueroa
(74) *Attorney, Agent, or Firm* — Crawford Maunu PLLC

(57) ABSTRACT

A floor assembly for a performance space is disclosed. The assembly has a planar resilient floor board supported above a base board on a primary support system comprising a plurality of resilient (preferably elastomeric) supports. A secondary support system comprises a plurality of fixed support members and a plurality of movable support members. Each movable support member is movable in a direction parallel to the plane of the floor board between a first position spaced from a corresponding fixed support member such that the floor board is unsupported by the support members and a second position in contact with the corresponding fixed support member such that the floor board is supported by the support members. In the first position, the floor board is in a sprung configuration and in the second position, the floor board is in an unsprung configuration. The invention therefore provides a performance floor which is switchable between sprung and unsprung configurations.

10 Claims, 9 Drawing Sheets

(56) References Cited

FOREIGN PATENT DOCUMENTS

| | | | |
|---|---|---|---|
| DE | 202018106568 | U1 | 3/2019 |
| KR | 102028889 | B1 | 10/2019 |

* cited by examiner

PERFORMANCE FLOOR ASSEMBLY AND SYSTEM

TECHNICAL FIELD

The present invention relates to a floor assembly and floor system for use in theatres, opera houses, dance studios and other performance or rehearsal spaces.

BACKGROUND

Sprung floors in theatres, opera houses, dance studios and other performance or rehearsal spaces are known and are primarily used for dance or acrobatic performances where it is desirable to cushion the landing of the performer to protect joints, bones and muscles. One such sprung floor system is the commercially-successful "Liberty" system available from the applicants.

Performance venues will be used for both dance and theatrical performances and therefore there is a need for a venue to be able to provide both a sprung floor and a rigid floor depending on the type of performance. Typically, a sprung floor will be stored in wagons and, when required, will be laid on top of the fixed stage floor. This has several disadvantages, in that significant storage space is required for the sprung floor when not in use, and also that laying and dismantling the floor takes time and requires significant manpower.

Furthermore, when a sprung floor is in use, it is not possible to move heavy objects such as vehicles or scenery across the floor without risking damage. In addition, a performance may require a floor with a rigid area and a sprung area, for example if scenery is to be supported during a dance performance.

Dance studios and rehearsal spaces may also benefit from being able to provide both a sprung floor and a rigid floor, but the storage space needs for the sprung floor and the cost of laying and dismantling each time may be prohibitive for such venues. Therefore, there is a need for an improved sprung floor system which overcomes the above disadvantages.

DE 202018106568 U1 discloses a sprung floor system which can be switched between a sprung mode and a rigid mode by means of a pneumatically-actuatable support plate. The support plate has a rest position in which there is no contact with the floor, allowing the floor to be in sprung mode, and a support position in which the support plate is extended to contact the underside of the floor and make the floor more rigid. This system has several disadvantages, discussed below, and there is still a need for an improved, switchable sprung floor system.

SUMMARY OF THE INVENTION

In accordance with a first aspect, the invention provides a floor assembly for a performance space, the performance space providing a support surface for the floor assembly, the floor assembly comprising: a planar resilient floor board supported by a primary support system comprising a plurality of resilient supports for load-bearing support by the support surface, and a secondary support system comprising a plurality of corresponding pairs of support members, each pair comprising a fixed support member and a movable support member, wherein the movable support member is movable in a direction parallel to the plane of the floor board between a first position spaced from the fixed support member such that the floor board is unsupported by the support members and a second position in contact with the fixed support member such that the floor board is supported by the support members.

The contact/load path between the floor board and the support surface via the resilient supports may be direct or indirect, i.e. there could be other structural components in between. Similarly, in the second position, the contact/load path between the floor board and the support surface via the movable and fixed support members may also be direct or indirect.

In the first position, the support members in each pair are preferably spaced horizontally from one another and are not in contact. They are therefore out of alignment. In the first position therefore, the floor board is in a sprung configuration and its resilient properties are preferably substantially unchanged compared to a floor assembly without the secondary support system.

In the second position, the support members in each pair are in contact and preferably overlap or overlie in the vertical direction. The support members provide a support load path from the floor board to the support surface. In the second position therefore, the resilient properties of the floor board are preferably reduced or substantially removed compared to the sprung configuration, and the floor board can be said to be in an unsprung configuration.

In the context of the present invention, the terms "sprung" and "unsprung" are relative. In the sprung configuration, the floor board has more resilience and a lower load-bearing capability. In the unsprung configuration, the floor board has less resilience and a higher load-bearing capability.

The term "resilience" in relation to the floor board refers to the ability of the board to flex in a direction perpendicular to the plane of the board, i.e. vertically. The floor board may be made from a resilient or non-resilient material however. In relation to the resilient support of the primary support system, resilience refers to the ability of the support material to compress under load, i.e. in the vertical direction, and spring back. The resilient support is therefore made from a resilient material, which may be elastomeric.

The fixed and movable support members may be formed from any suitable material, however the fixed and movable support members are preferably made from a non-elastomeric material and preferably a non-resilient material. Preferably the fixed and movable support members are solid. Preferred materials are relatively hard materials such as wood, metal or plastics. UHMW polyethylene or PTFE are preferred plastics materials. These materials also benefit from low friction coefficients and can therefore slide together into an overlapping configuration more easily than other materials.

It is envisaged that the fixed support members may be fixed to the support surface and the movable support members move between the floor board and the fixed support members. However, in a preferred embodiment, the fixed support members are attached to the underside of the floor board. The movable support members will therefore move between the fixed support members and the support surface.

The fixed support member may comprise a layer block or pad of material. Each fixed support member may be formed from a single, unitary block or pad, but in a preferred embodiment with particular advantages, each fixed support member is formed from a plurality of support pads spaced from each other. This provides an important advantage in that the stiffening effect on the floor board of the plurality of pads is less than that of a single, unitary support member of the same area. The gaps between each pad do not need to be particularly large, but just sufficient to allow relative movement between the pads when the floor board flexes.

Forming the support member from a plurality of pads can also provide the advantage of spreading the load over a larger area while not increasing the stiffening effect compared to that of a single, unitary support member of smaller area.

In order to allow a smooth transition to the second position (unsprung configuration), each fixed support member may be provided with a rounded or angled edge facing the direction of movement of the movable support member. This will prevent the support member edges contacting and locking up if the vertical position of the floor board has dropped slightly.

The movable support members may be movable in any direction or path parallel to the plane of the floor board (e.g. a curved or circular path), but preferably they are movable in a linear direction parallel to the plane of the floor board.

In a particularly preferred arrangement, a plurality of movable support members are mounted on a track and connected so as to be movable together. The track may be continuous or may be discontinuous and comprise a plurality of spaced track sections. The movable support member may comprise a carriage or carrier configured to move along the track. The carrier itself may be the movable support member and directly contact the fixed support member in the unsprung configuration. Alternatively, the movable support member may be provided on the carrier in the form of an additional layer or block of material.

In any embodiment, the movable support members may be movable by means of a rope, cable, rod, bar, threaded rod, leadscrew, etc. The support members may be movable manually (e.g. by means of a mechanism which may include a winding handle, gears, ratchet, lever, etc.) or by means of a motor, such as an electric or hydraulic motor. One or more motors may be located at convenient locations to move the support members individually or in groups. In the track-mounted arrangement discussed above, a motor may be located at each end of the track and configured in a pull-pull arrangement so that the motors operate individually and only pull the support members between the sprung and unsprung configurations.

As with the fixed support members, each movable support member may be provided with a rounded or angled edge facing the direction of movement of the movable support member.

In accordance with a second aspect, the invention provides a modular floor system for a performance space comprising a plurality of interconnected floor assemblies as described above. The floor system is preferably configured such that the sprung or unsprung configuration (i.e. first or second position of the movable support members) of the secondary support system of each assembly may be independently set. This enables each module to be set according to its use, for example if part of the floor area will be used for a dance performance and another part will be required to support.

At least in its preferred embodiments, the present invention provides significant advantages over the prior art, including the system of DE 202018106568 U1 discussed above.

Unlike the system of DE 202018106568 U1, which requires energy in the support (unsprung) position to maintain the pneumatic pressure to keep the support plate raised and in contact with the floor, the present invention is entirely passive in both sprung and unsprung configurations. The only energy required is to move the support members between one position and the other. The system will not consume any energy in either position and will also be silent, unlike the prior art system which may require a compressor to run at least intermittently. Therefore, the floor system of the present invention may be configured for an entire production run.

The present invention will also require less vertical space than the prior art system in view of the horizontal movement of the support members, as opposed to the vertical movement in the prior art.

Overall, the present invention provides a system which is reliable and straightforward to install, operate and maintain. With an appropriate control system, the system is easily configurable to set individual floor modules (or even individual pairs of support members) in the required sprung or unsprung configuration.

BRIEF DESCRIPTION OF THE DRAWINGS

Embodiments of the invention will now be described by way of example only and with reference to the accompanying drawings, in which.

DETAILED DESCRIPTION OF PREFERRED EMBODIMENTS

Figure 1:
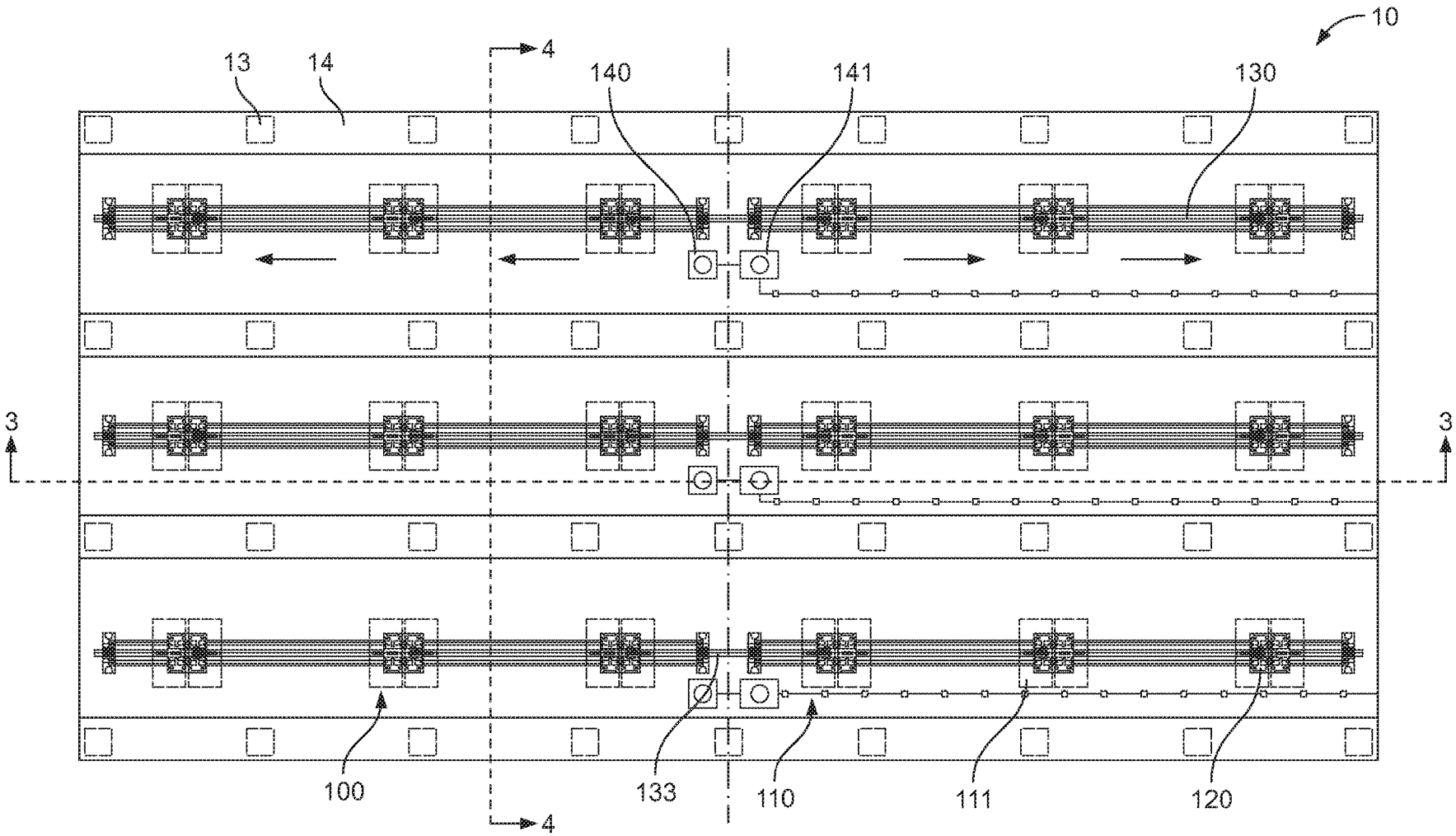
FIG. 1 shows a schematic plan view of a floor assembly for a theatre stage in accordance with a first embodiment of the invention in an unsprung configuration.
Figure 2:
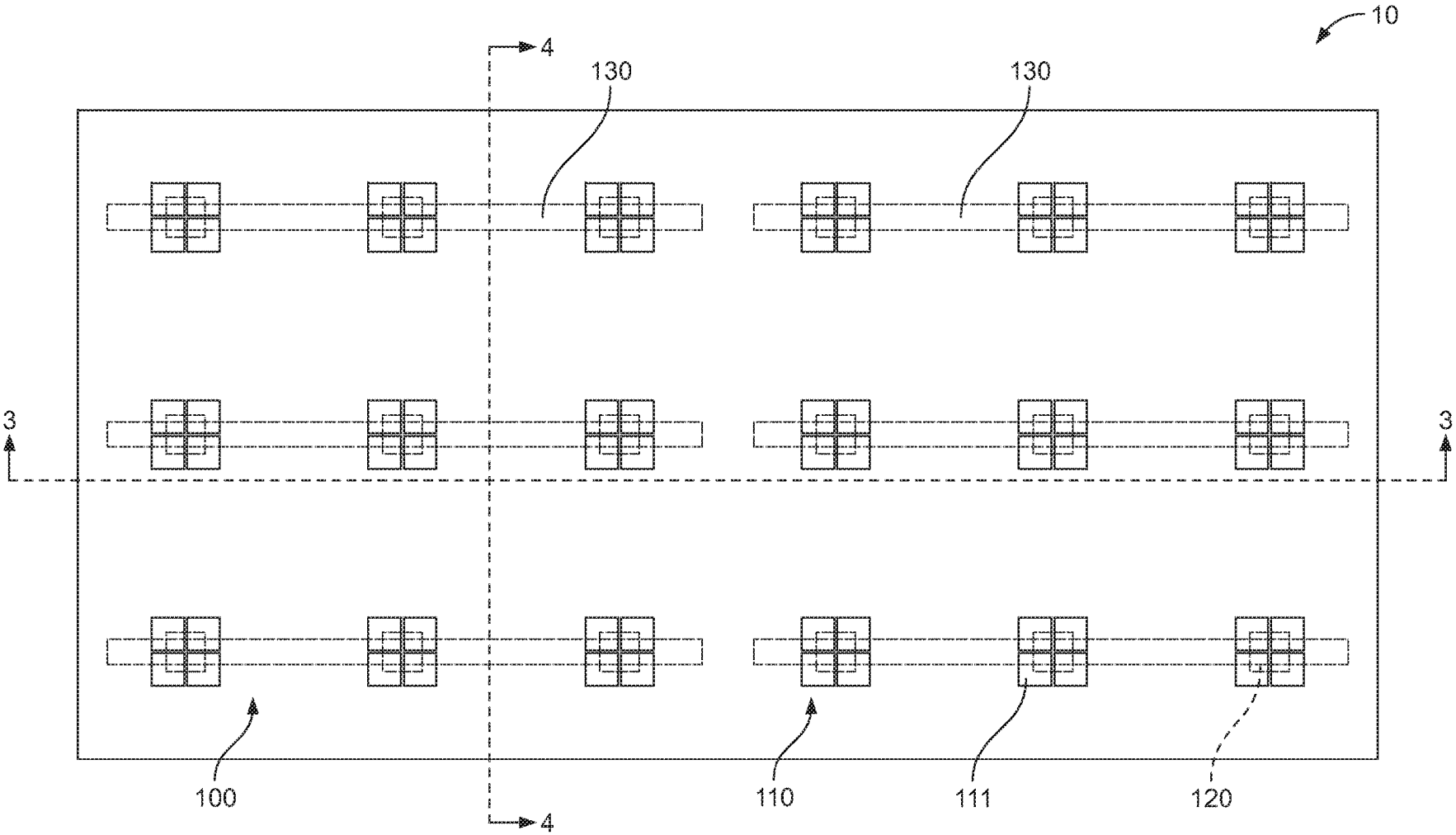
FIG. 2 shows a simplified schematic plan view of the floor assembly of FIG. 1.

FIGS. 1-4 show a floor assembly in accordance with a first embodiment, suitable for a theatre stage. The first embodiment is configured to be fully modular and individual floor assemblies can be removed for lifts, traps, etc. without affecting the operation of the adjacent assemblies. In theatres, it will usually be possible to access the stage floor from underneath for repair or maintenance, and therefore each assembly may have its own individual drive motor as discussed below.

The floor assembly is based on a standard "Liberty" floor assembly manufactured and sold by the applicants. The standard floor assembly 10 comprises a planar, resilient floor board 11 typically made from 18 mm birch plywood board and a base board 12, which may be made from the same material. The floor board 11 is mounted on a plurality of resilient, elastomer blocks 13 as the primary support system, which are typically 50 mm square and 18 mm deep, which in turn rest on a plurality of battens 14, which are typically 18-38 mm in depth and 80 mm wide. In this standard form, through a combination of the material properties of the floor board 11 and the resilient elastomer blocks 13, the floor assembly provides a sprung performance surface.

As shown in FIGS. 1-4, a secondary support system 100 in accordance with a first embodiment of the invention is provided. The system comprises a plurality of fixed or static support members 110 which are attached to the underside of floor board 11 and a plurality of movable support members 120 which are movable along a linear track 130 mounted on base board 12.

Each fixed support member 110 comprises four support pads 111 arranged in a square with a small gap between each pad. As discussed above, this reduces the stiffening effect on floor board 11 compared to a solid pad of the same area, or allows a larger contact area while not increasing the stiffening effect. In a preferred embodiment, each support pad 111 is 60 mm square and is made from UHMW polyethylene or PTFE.

Figure 10B:
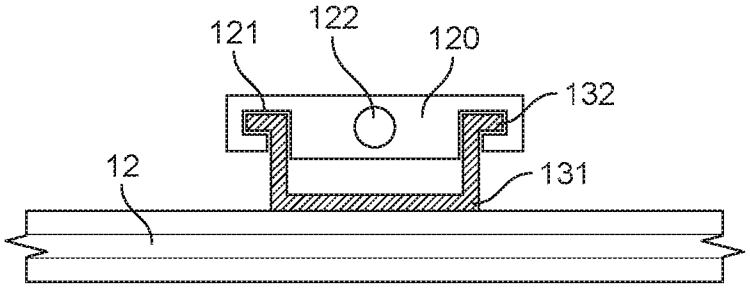
FIGS. 10A and 10B show schematic plan and sectional views of the track and block system for use with either embodiment of the invention.
Figure 10A:
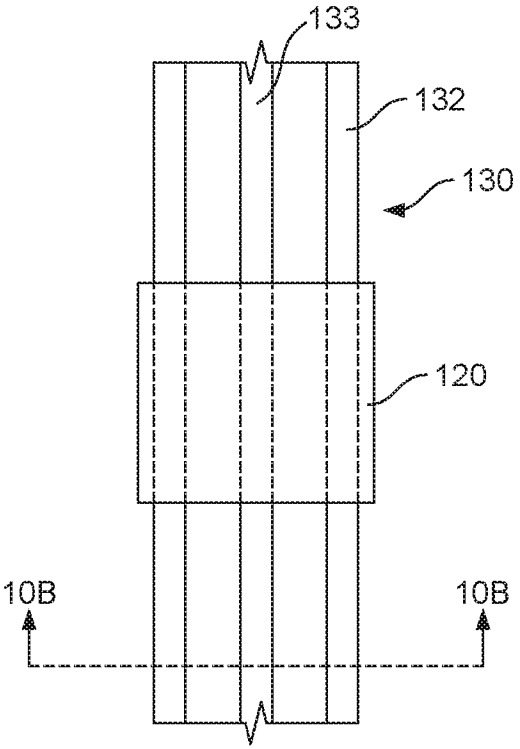

Track 130 is shown in more detail in FIGS. 10A and 10B and comprises a generally U-shaped channel 131 providing two flanged rails 132 along which movable support members 120 can slide. Each movable support member has channels 121 having profiles corresponding to the profiles of the flanged rails 132. An externally-threaded rod or lead screw 133 is inserted in an internally-threaded hole 122 in the movable support member 120 such that rotation of the threaded rod 133 moves the support member 120 in a linear direction along the track 130.

In a preferred embodiment, each movable support member 120 is 75 mm×70 mm and is made from UHMW polyethylene or PTFE.

Referring to the first embodiment of FIGS. 1-4, each floor assembly 10 is provided with six secondary support systems 100, each comprising a track section 130 and three sets (pairs) of support members 110 and 120. Each threaded rod 133 (FIG. 1) is driven by a motor 140 controlled by a drive controller 141. The secondary support systems may be individually controlled, thus allowing a high degree of versatility even within each assembly. In the embodiment shown, the threaded rods of each pair of track sections 130 are connected axially and each pair is driven by a centrally-mounted motor 140. The operation of the secondary support system 100 can be understood with reference to FIGS. 3A and 3B.

Figure 3A:
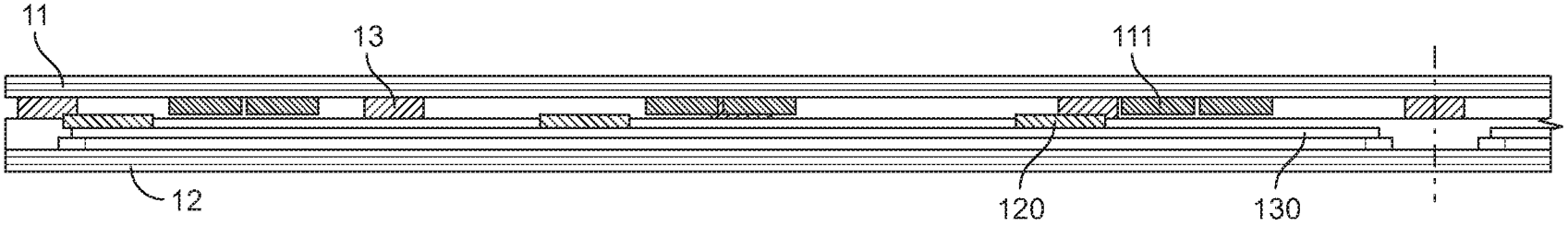
FIGS. 3A and 3B show schematic section views along line 3-3 of FIGS. 1 and 2, in sprung and unsprung configurations respectively.

In FIG. 3A, the movable support members 120 are in the first position, spaced horizontally from the corresponding fixed support members 110. Therefore, the secondary support system does not provide any additional support to the floor board 11 and the floor assembly is in a sprung configuration.

Figure 3B:
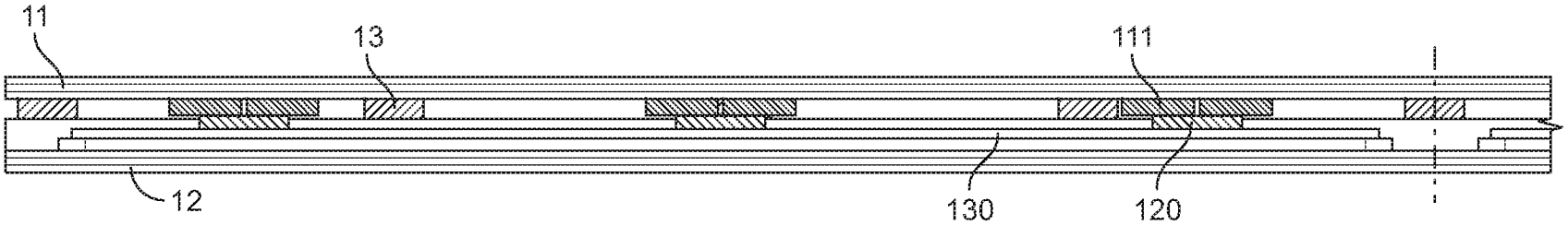
Figure 4:
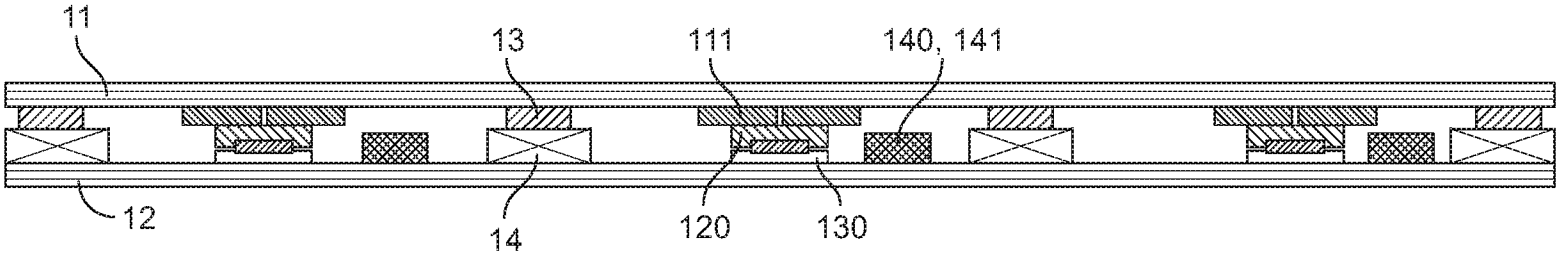
FIG. 4 shows a schematic section view along line 4-4 of FIGS. 1 and 2.
Figure 5:
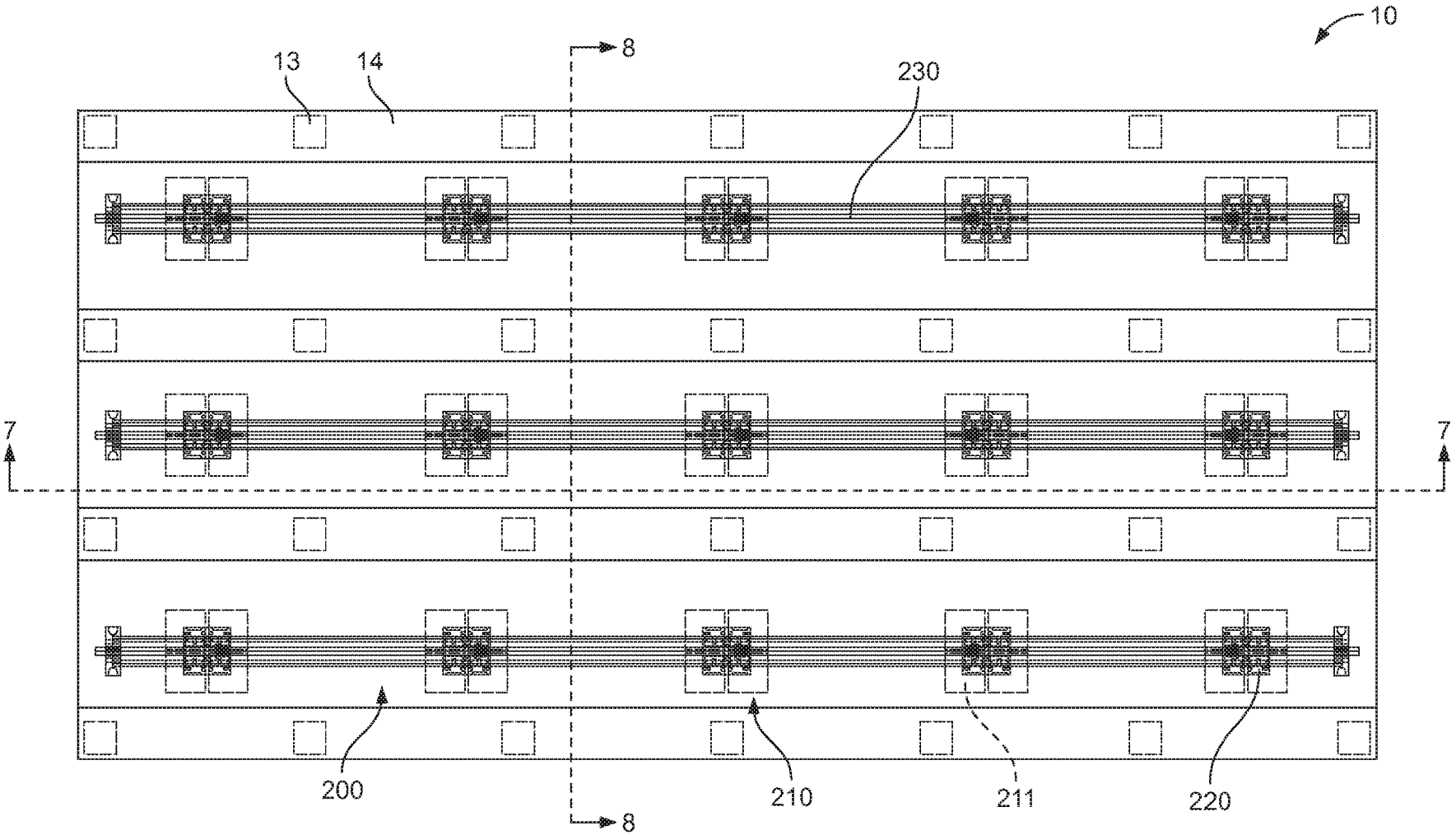
FIG. 5 shows a schematic plan view of a floor assembly for a studio in accordance with a second embodiment of the invention in an unsprung configuration.
Figure 6:
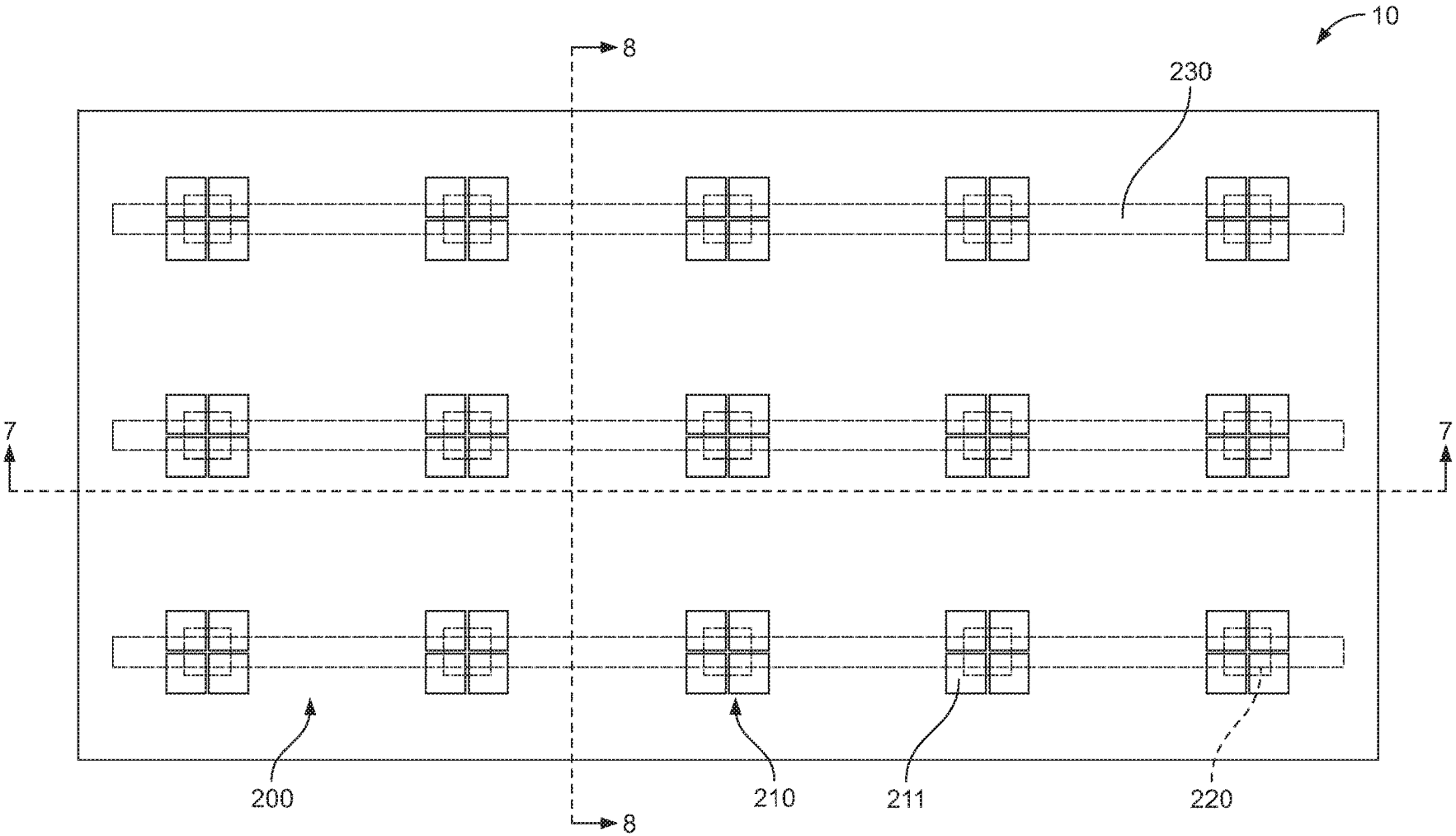
FIG. 6 shows a simplified schematic plan view of the floor assembly of FIG. 5.

In FIG. 3B, the movable support members 120 are in the second position and are vertically aligned under the corresponding fixed support members 110. Therefore, the secondary support system provides additional support to the floor board 11 and the floor assembly is in an unsprung configuration.

FIGS. 5-9 show a floor assembly in accordance with a second embodiment, suitable for a studio. Unlike the theatre version, once the floor is installed, it will not be possible to access the secondary support system and therefore a different configuration is desirable as discussed further below. Restrictions on space and cost may also be relevant for this application of the invention.

The floor assembly is again based on a standard "Liberty" floor assembly manufactured and sold by the applicants. The assembly 10 has the same features as the first embodiment and comprises a planar, resilient floor board 11, base board 12, elastomer blocks 13 and battens 14.

A secondary support system 200 in accordance with a second embodiment of the invention is provided. The system comprises a plurality of fixed or static support members 210 which are attached to the underside of floor board 11 and a plurality of movable support members 220 which are movable along a linear track 230 mounted on base board 12.

Each fixed support member 210 comprises four support pads 211 arranged in a square with a small gap between each pad. As discussed above, this reduces the stiffening effect on floor board 11 compared to a solid pad of the same area, or allows a larger contact area while not increasing the stiffening effect. In a preferred embodiment, each support pad 211 is 60 mm square and is made from UHMW polyethylene or PTFE.

Movable support member 220 and track 230 are the same in detail as the movable support member 120 and track 130 shown in FIGS. 10A and 10B. In a preferred embodiment, each movable support member 220 is 75 mm×70 mm and is made from UHMW polyethylene or PTFE.

Referring to the second embodiment of FIGS. 5-9, each floor assembly 10 is provided with three secondary support systems 200, each comprising a track section 230 and five sets (pairs) of support members 210 and 220.

Figure 9:
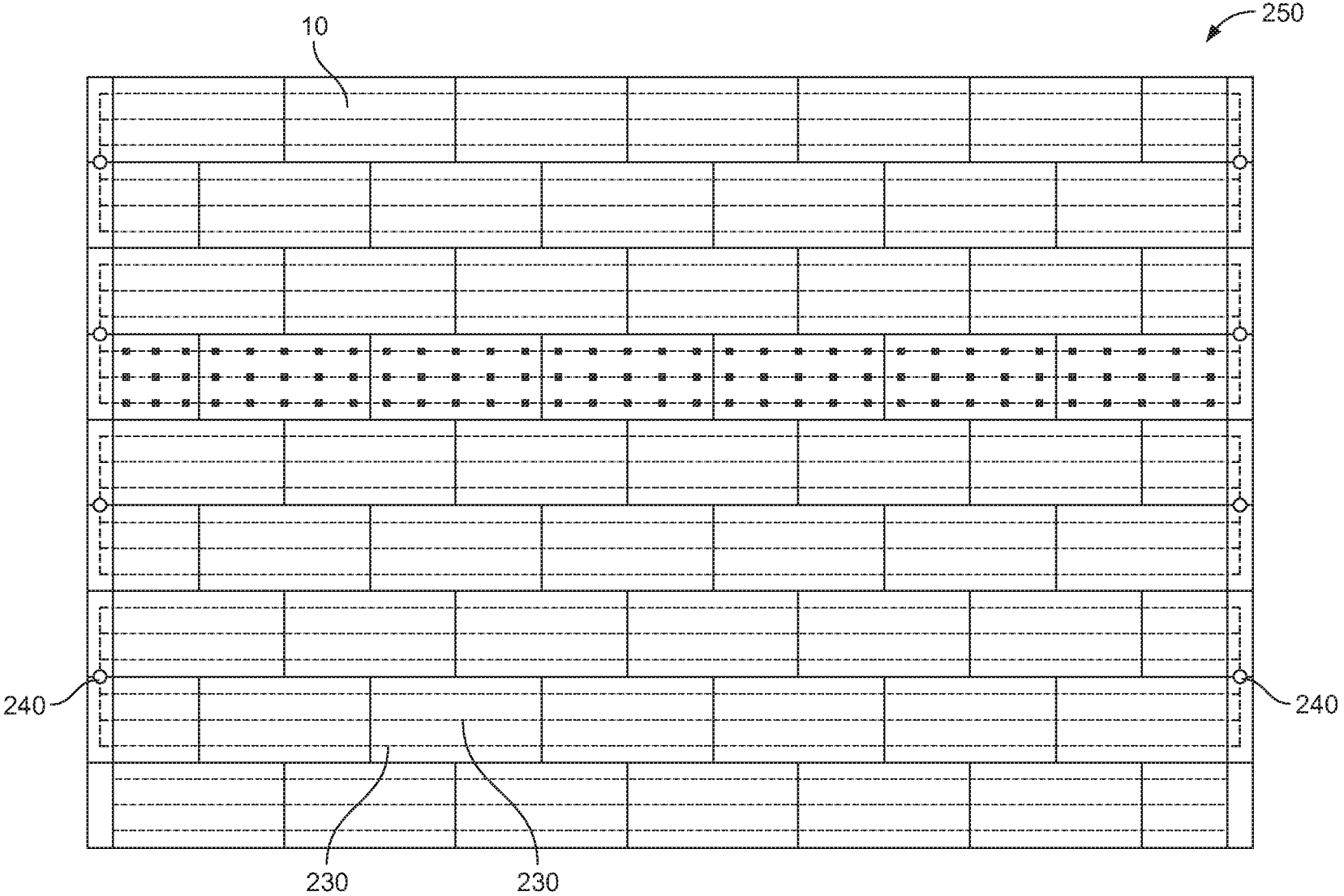
FIG. 9 shows a schematic plan view of a studio floor comprising the floor assemblies of the second embodiment.

In the studio version of the second embodiment, it will not be possible to access the secondary support system once the floor is installed. Therefore, unlike the first embodiment, each floor assembly of the studio version is not provided with its own individual drive motor or motors. FIG. 9 shows how the floor assemblies are connected into an array 250 of floor assembly modules. When the floor is installed, the track sections 230 of adjacent assemblies are connected together axially, in parallel. Motors 240 are installed at the ends of each line of assemblies, located in compartments which are accessible for repair or maintenance. A motor may drive more than one line of tracks 230. In FIG. 9, each motor drives six lines of tracks via a system of drive belts, with a motor at each end in a "push-pull" configuration.

It will be apparent that the second embodiment provides a lesser degree of individual control of the sprung/unsprung configuration of each assembly, although zoning will still be possible to some extent as will be apparent from FIG. 9. The advantages of the invention as discussed above are still achieved however.

Figure 7A:
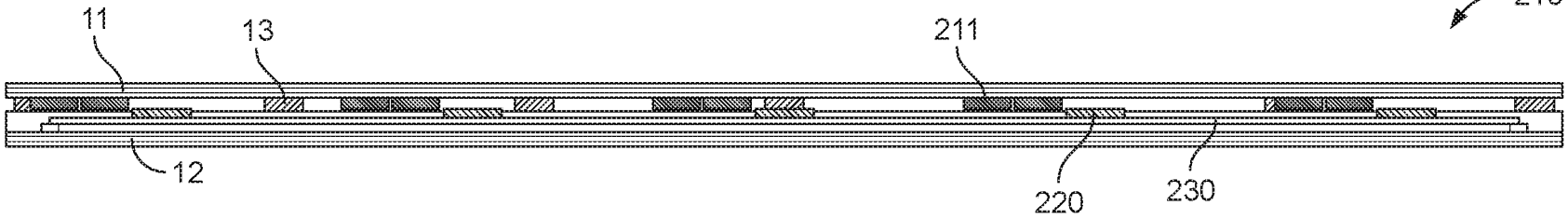
FIGS. 7A and 7B show schematic section views along line 7-7 of FIGS. 5 and 6, in sprung and unsprung configurations respectively.
Figure 7B:
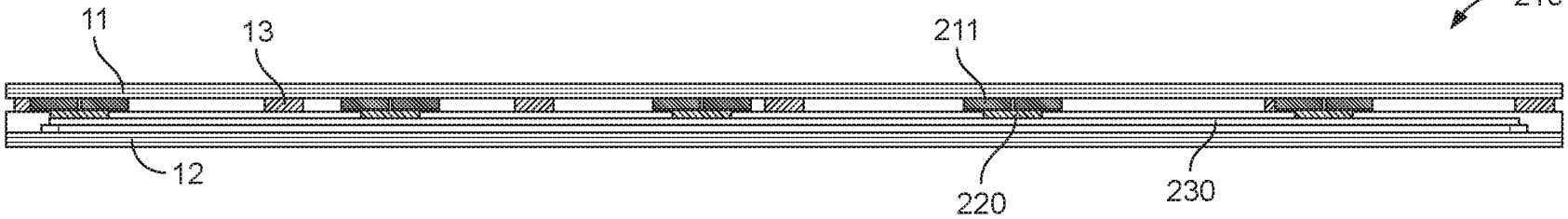
Figure 8:
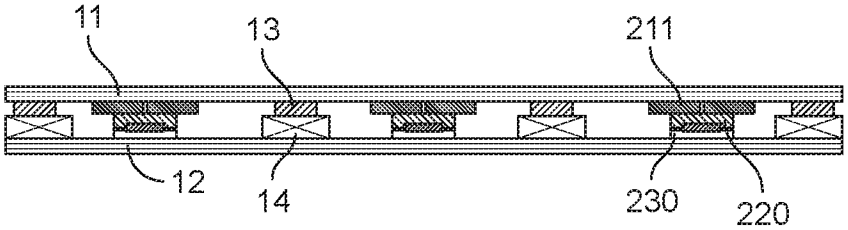
FIG. 8 shows a schematic section view along line 8-8 of FIGS. 5 and 6.

The operation of the secondary support system 200 can be understood with reference to FIGS. 7A and 7B.

In FIG. 7A, the movable support members 220 are in the first position, spaced horizontally from the corresponding fixed support members 210. Therefore, the secondary support system does not provide any additional support to the floor board 11 and the floor assembly is in a sprung configuration.

In FIG. 7B, the movable support members 220 are in the second position and are vertically aligned under the corresponding fixed support members 210. Therefore, the secondary support system provides additional support to the floor board 11 and the floor assembly is in an unsprung configuration.

Figure 11:
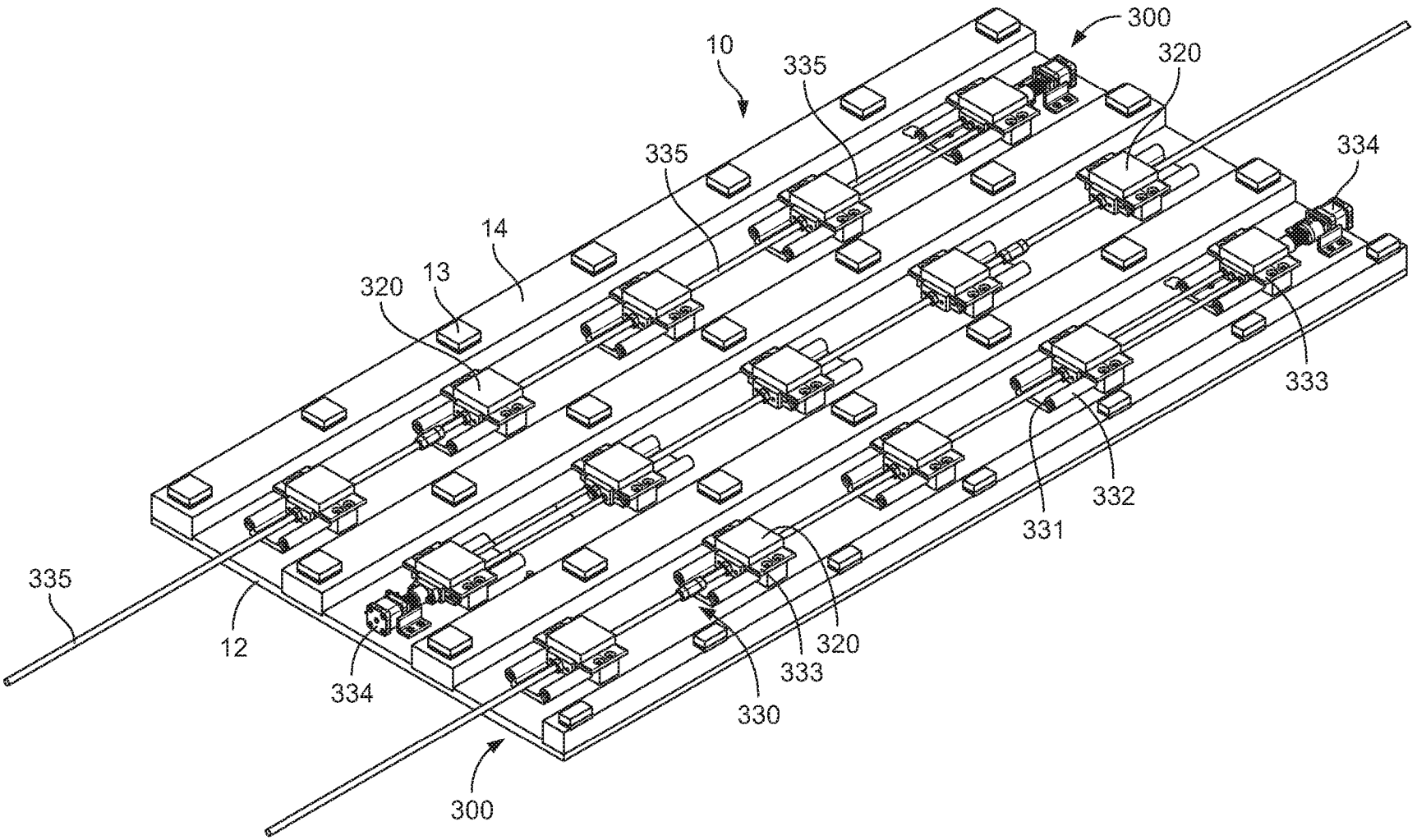
FIG. 11 shows a perspective view of a floor assembly in accordance with a third embodiment.

FIG. 11 shows a floor assembly 10 in accordance with a third embodiment, which is a "universal" assembly suitable for a theatre, studio or any other location. The floor assembly is again based on a standard "Liberty" floor assembly manufactured and sold by the applicants. For clarity, the resilient floor board 11 has been removed in this figure but base board 12, elastomer blocks 13 and battens 14 are shown.

A secondary support system 300 in accordance with a third embodiment of the invention is provided. The system comprises a plurality of fixed or static support members (not shown) which are attached to the underside of floor board (not shown) and a plurality of movable support members 320 which are movable along a plurality of linear track assemblies 330 mounted on base board 12, similar in operation to the other embodiments. Three secondary support systems 300 are provided on the floor assembly.

Each fixed support member and each movable support member 320 may have the same configuration or materials as described above for the first or second embodiments.

The track system in this embodiment comprises a plurality of discontinuous track assemblies 330. This configuration may be employed in the other embodiments also. Each track assembly 330 comprises a generally U-shaped channel section 331 having flanged or rounded rails 332. A carrier 333 is mounted on the rails and configured to slide in either direction along the rails. Movable support member 320 is mounted on carrier 333 and moves with the carrier between the unsprung position and the sprung position in a similar manner to the other embodiments.

A motor 334 is provided for moving each group of five carriers in the secondary support system, which are interconnected by means of connecting rods 335. In a preferred embodiment, the rod connecting the motor to the first carrier is a threaded rod and the rods between the other carriers are solid and fixed to the carriers so that they do not move or rotate relative to the carriers. This avoids the need to provide a threaded rod along the entire assembly, simplifying the construction. Further connecting rods may extend to adjacent floor assemblies.

The invention claimed is:

1. A floor assembly for a performance space, the performance space providing a support surface for the floor assembly, the floor assembly comprising:

a planar resilient floor board supported by a primary support system comprising a plurality of resilient supports for load-bearing support by the support surface, and a secondary support system comprising a plurality of corresponding pairs of support members, each pair comprising a fixed support member and a movable support member, wherein the movable support member is movable in a direction parallel to the plane of the floor board between a first position spaced from the fixed support member such that the floor board is unsupported by the support members and a second position in contact with the fixed support member such that the floor board is supported by the support members.

2. The floor assembly of claim 1, wherein the fixed and movable support members are made from a non-elastomeric and preferably a non-resilient material.

3. The floor assembly of claim 1, wherein the fixed support member is attached to the underside of the floor board.

4. The floor assembly of claim 1, wherein the fixed support member is formed from a plurality of smaller support pads spaced from each other.

5. The floor assembly of claim 1, wherein the fixed support member is provided with a rounded or angled edge facing the direction of movement of the movable support member.

6. The floor assembly of claim 1, wherein the movable support member is provided with a rounded or angled edge facing the direction of movement of the movable support member.

7. The floor assembly of claim 1, wherein the movable support member is movable in a linear direction parallel to the plane of the floor board.

8. The floor assembly of claim 1, wherein a plurality of the movable support members are mounted on a track and connected so as to be movable together.

9. A modular floor system for a performance space comprising a plurality of interconnected floor assemblies of claim 1.

10. The modular floor system of claim 9, wherein the modular floor system is configured such that the configuration of the secondary support system of each floor assembly may be independently set.

* * * * *